US006364707B1

(12) United States Patent
Wang

(10) Patent No.: US 6,364,707 B1
(45) Date of Patent: Apr. 2, 2002

(54) GROUNDING DEVICE OF AN ELECTRIC CONNECTOR

(76) Inventor: Yao Te Wang, 2F, No. 11, Alley 2, Lane 31, Sec. 3, An Kang Rd., Hsin Tien City, Taipei Hsien (TW)

( * ) Notice: Subject to any disclaimer, the term of this patent is extended or adjusted under 35 U.S.C. 154(b) by 0 days.

(21) Appl. No.: 09/729,970

(22) Filed: Dec. 6, 2000

(51) Int. Cl.[7] ..... H01R 13/648
(52) U.S. Cl. ..... 439/607; 439/939
(58) Field of Search ..... 439/92, 607–610, 439/939

(56) References Cited

U.S. PATENT DOCUMENTS 4,906,201 A * 3/1990 Young et al. ..... 439/939
6,074,222 A * 6/2000 Kuo ..... 439/939
6,113,428 A * 9/2000 Yeh ..... 439/939
6,132,253 A * 10/2000 Wu ..... 439/939
6,139,367 A * 10/2000 Yeh ..... 439/939
6,168,448 B1 * 1/2001 Chang ..... 439/939

* cited by examiner

*Primary Examiner*—Gary F. Paumen
(74) *Attorney, Agent, or Firm*—Rosenberg, Klein & Lee

(57) ABSTRACT

A grounding device of an electric connector is disclosed. An insulating seat is installed with a plurality of terminals and is installed with a spacer. A housing encloses the insulating seat and made of metal material. A clamping piece has a ⊏ shape and is made of metal material. The clamping piece is positioned to the spacer and the housing. Two sides of a meddle connecting piece of the clamping piece each are protruded with a combining portion. A pair of ground pieces has a T shape with one end being a retainer and another two ends being resisting portions. The retainer is inserted into the middle connecting piece of the clamping piece. A punched buckling portion is formed on the retainer near the resisting portion. Thereby, the combining portion is inserted into a hollow chamber in the buckling portion and is pressed and thus fixed therein. Between the buckling portion of the retainer and the resisting portion is formed with an oblique extended bending portion. The resisting portion of the ground piece is parallel to the middle connecting piece of the clamping piece.

4 Claims, 6 Drawing Sheets

GROUNDING DEVICE OF AN ELECTRIC CONNECTOR

FIELD OF THE INVENTION

The present invention relates to a ground piece of an electric connector, and especially to a ground piece used to a connector of a universal serial bus with double seat.

BACKGROUND OF THE INVENTION

With the improvement of computer science, the connectors of universal series bus (USB) are necessary elements. In general, they are used in interfaces for connecting a keyboard or a mouse to a main frame. The double seat connector is modified from the single seat connector and is employed to be connected with two connectors at the same time. Moreover, the double seat connectors has various applications instead of merely being used in a keyboard or a mouse. In the prior art, a double seat stacked connector 2*a* is not connected with the housing 1*a* of the mainframe. As illustrated in FIG. 1, only a retaining piece 11*a* is installed on the back plate of the mainframe. The retaining piece 11*a* serves to position all the connectors of interfaces. The retaining piece is made according to the specification for designing a connector. The most original way is to be formed with a square hole 12*a*. The inner diameter of the square hole 12*a* is slightly smaller than the size of the periphery of a connector. A retaining strip 13*a* is transversally installed in the middle portion of the square hole 12*a* of the retaining piece 11*a*. Initially, the retaining strip 13*a* has an effect of positioning so that the connector 2*a* installed in the housing 1*a* can not be pulled out from the square hole 12*a*. While a plug type connector matched the housing must pass through the square hole 12*a* of the mainframe retaining piece 11*a*. The plug type connector is inserted into a receptacle type connector so that the matched connector can be assembled and matched. Since the connector has double seats, large pulling and inserting forces generates. In order to consider the electromagnetic interference, the interference electromagnetic wave must be cancelled. Therefore, a metal isolating piece must be placed at a middle portion of a double seat connector as a spacer for reducing the interference therebetween.

As shown in FIG. 1, a prior art is illustrated. A protrusion is formed for being connected to the retaining strip 13*a* of the retaining piece, so that the electromagnetic interference generated in two connecting modules is directly transferred to the housing 1*a*. The connector 2*a* has an insulating seat 22*a* and a metal casing 21*a*. The insulating seat 22*a* has a terminal set at an upper half and a terminal set at a lower half (not shown). The insulating seat 22*a* is inserted into the metal casing 21*a*. A positioning structure is positioned between the insulating seat 22*a* and the metal casing 21*a*. The positioning structure has no relation to the present invention and thus, the detail will not be described further. A transverse spacer extending forwards is installed at a middle portion of the insulating seat 22*a* (referring to FIG. 3). By the spacer, the insulating seat 22*a* is divided into an upper chamber 23 at the upper half and a lower chamber 24*a* at the lower half. Each chamber is provided with a space for combining with a matched connector. A metal clip piece 25*a* is inserted into the insulating seat 22*a*. The metal clip piece 25*a* has a ⊓ shape. Two ends of the metal clip piece 25*a* are inserted into the metal casing 21*a*. Meanwhile, two lateral sides of the metal clip piece 25*a* are inserted with respective hooks 26*a* for being buckled to the retaining hole 27*a* of the housing 21*a*. The inserting edges of the metal clip piece 25*a* each have a hook (not shown) for being inserted into the buckling groove (not shown) of the insulating seat.

A transverse portion from the folded two ends of the clamping piece 25*a* covers the outer surface of the spacer.

Namely, two ends of the clamping piece are adhered to the upper and lower two lateral surfaces of the spacer. Therefore, the aforesaid positioning structure serves to fix the clamping piece 25*a* to the housing 21*a* and therefore, a pair of outer folded pieces 28*a* which are opposite and punched outwards are installed on the transverse portion of the clamping piece 25*a*. Therefore, the outer folding pieces 28*a* are in contact with the retaining piece 13*a* so that the outer folding piece 28*a* has an effect of grounding. However, since the outer folded piece 28*a* only contacts the retaining piece 13*a* by a tip portion thereof, as it is used for a long time, it will fatigue and deformed by pressure so that the outer folded piece loses the function of grounding.

SUMMARY OF THE INVENTION

Accordingly, the primary object of the present invention is to provide a grounding device of an electric connector, ground pieces more flexibly and steadily are used extra auxiliary ground structure. Thereby, the resisting portion obliquely extended and having a plane shape is in contact with a housing so that the ground piece is connected to the housing in a surface contact way. The contact area is sufficient. Consequently, the ground piece is substantially guided and can be used for a longer time with fatigue in elasticity. A steady combination is formed with the housing. Even a matched connector is in a pulling away condition, it can acquire an inverse holding force so that the connector can be protected well and provides a well application.

To achieve the object, the present invention provides a grounding device of an electric connector is disclosed. An insulating seat is installed with a plurality of terminals and is installed with a spacer. A housing encloses the insulating seat and made of metal material. A clamping piece has a ⊏ shape and is made of metal material. The clamping piece is positioned to the spacer and the housing. Two sides of a meddle connecting piece of the clamping piece each are protruded with a combining portion. A pair of ground pieces has a T shape with one end being a retainer and another two ends being resisting portions. The retainer is inserted into the middle connecting piece of the clamping piece. A punched buckling portion is formed on the retainer near the resisting portion. Thereby, the combining portion is inserted into a hollow chamber in the buckling portion and is pressed and thus fixed therein. Between the buckling portion of the retainer and the resisting portion is formed with an oblique extended bending portion. The resisting portion of the ground piece is parallel to the middle connecting piece of the clamping piece.

The various objects and advantages of the present invention will be more readily understood from the following detailed description when read in conjunction with the appended drawing.

DETAILED DESCRIPTION OF THE PREFERRED EMBODIMENTS

Figure 1:
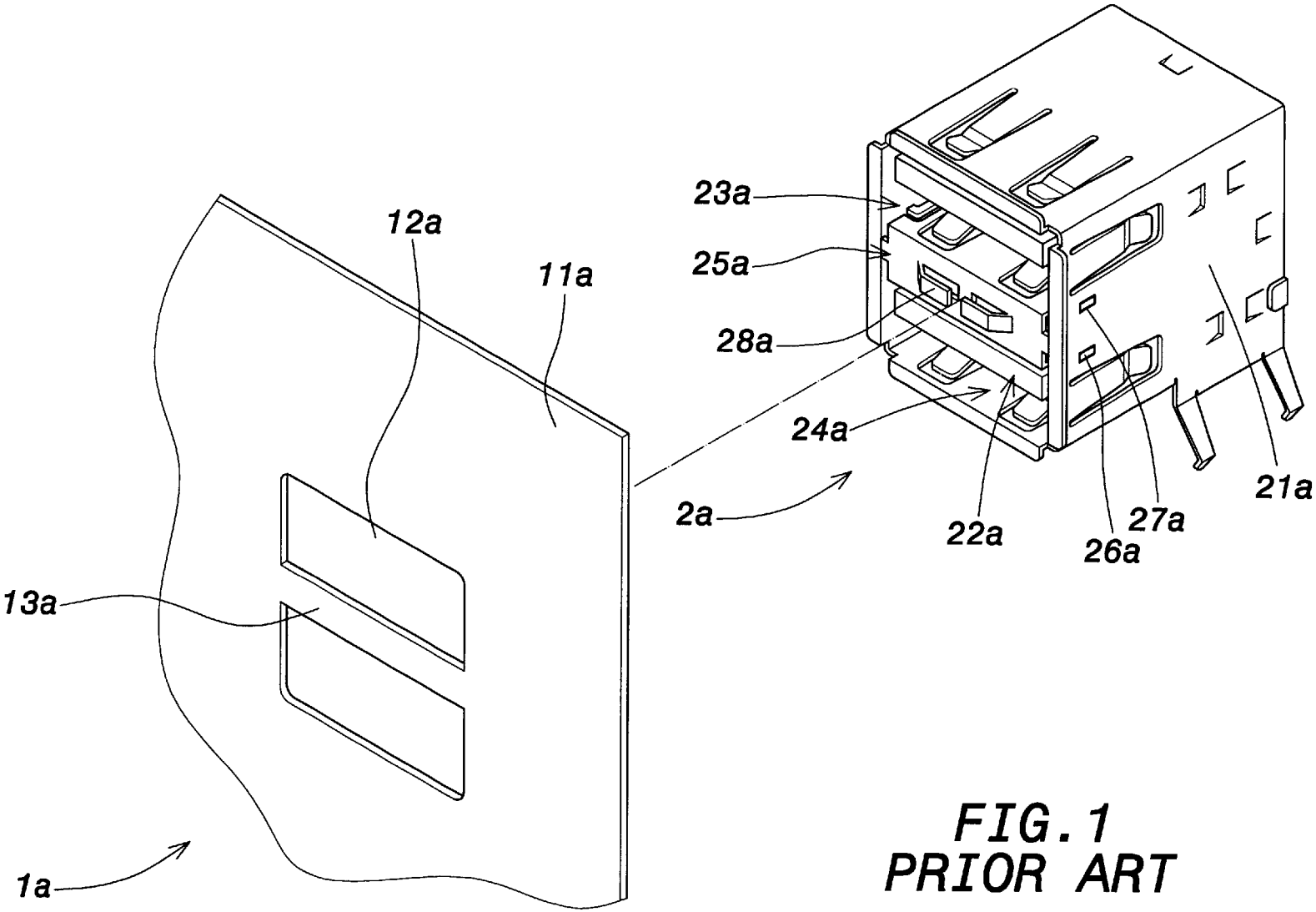
FIG. 1 PRIOR ART
FIG. 1 is a perspective view of a prior art design.
Figure 2:
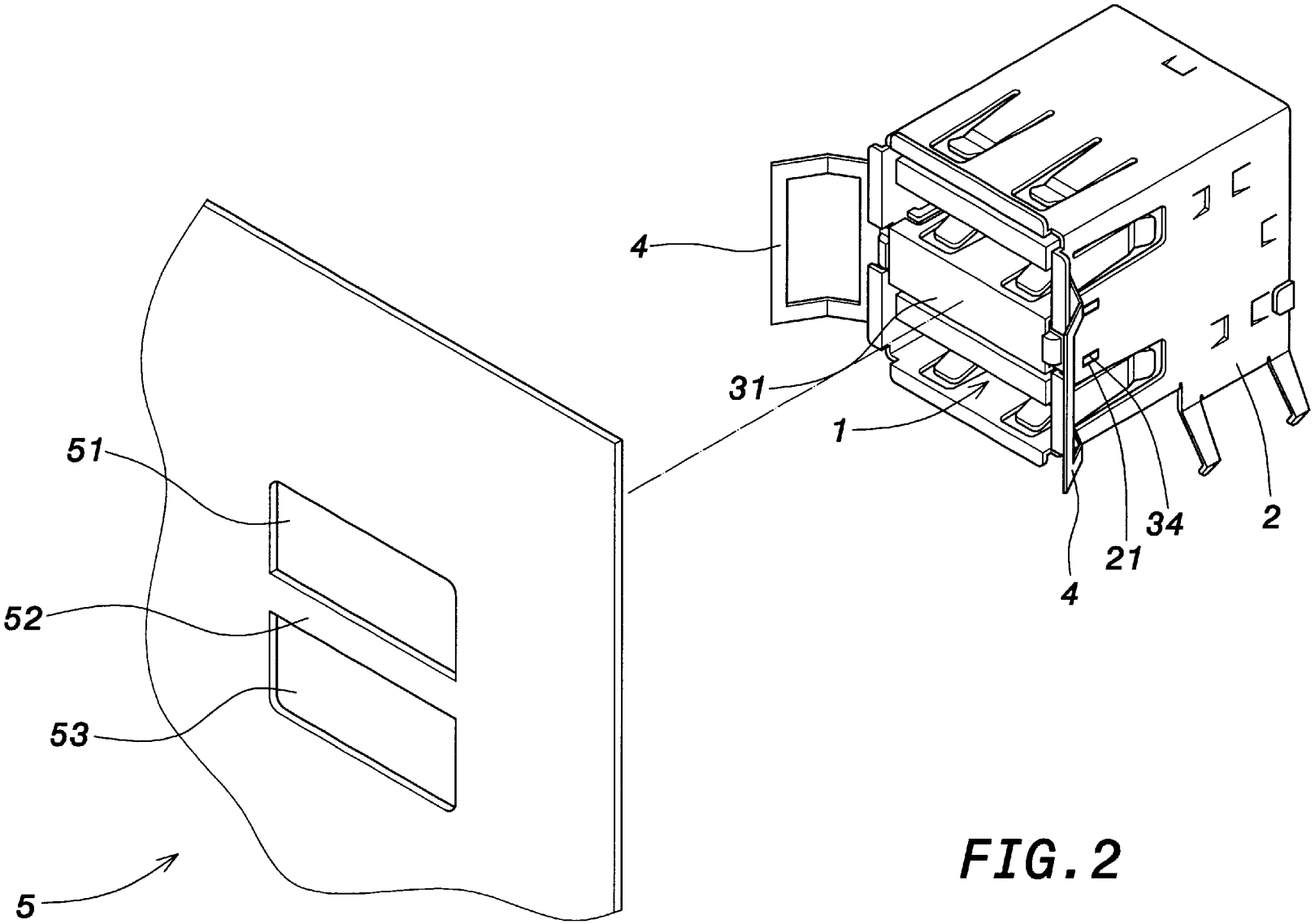
FIG. 2 is a prior art of the present invention.
Figure 3:
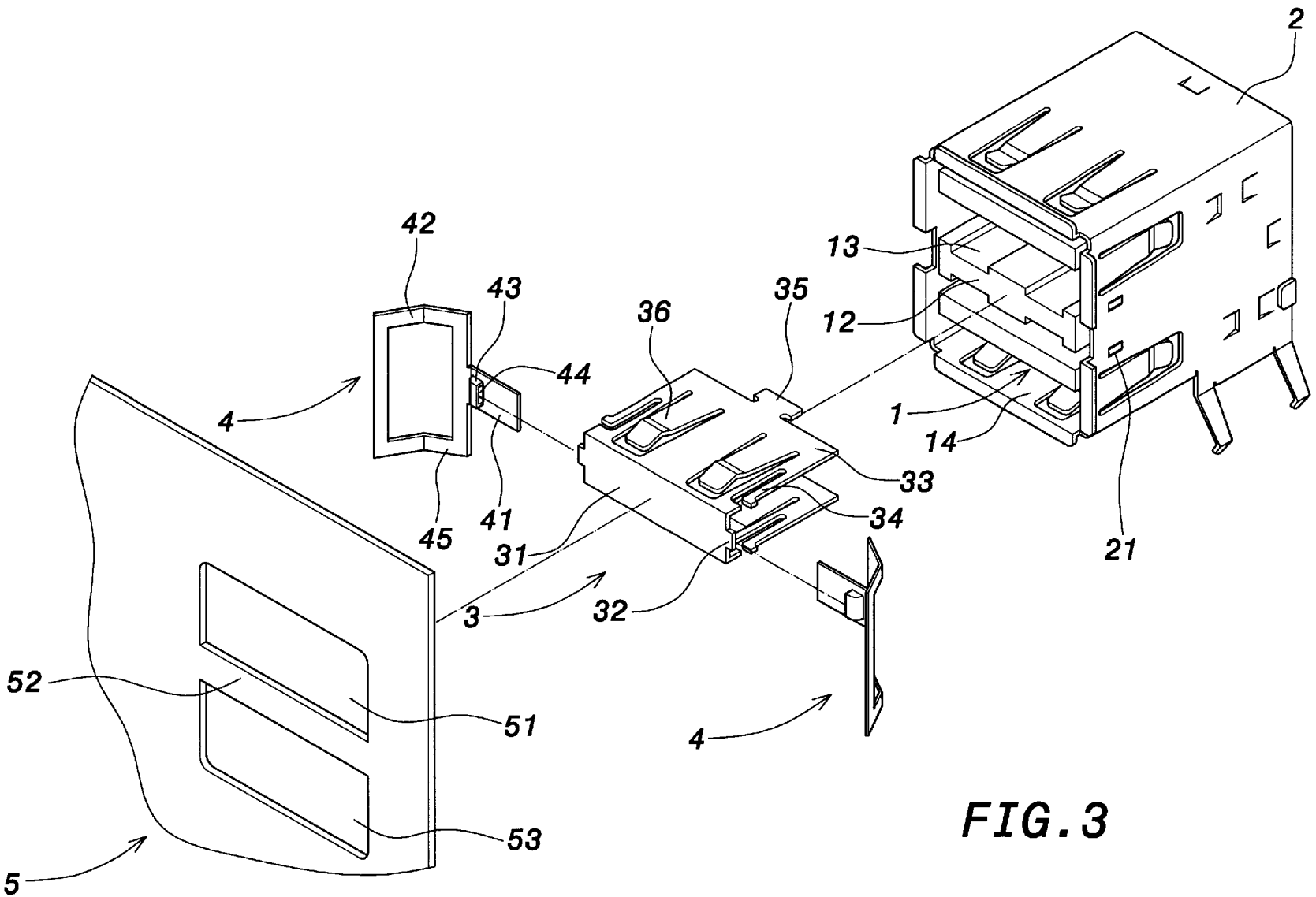
FIG. 3 is an exploded perspective view of the present invention.

A preferred embodiment of the present invention will be described hereinafter with the appended drawings. Thereby, the features and objects of the present invention can be appreciated from the description.

As shown in FIGS. 2 to 6, a grounding device of an electric connector of the present invention is illustrated. The grounding device of an electric connector includes an insulating seat 1 with a plurality of terminals 11 and a metal housing 2 enclosing the insulating seat 1. In general, the terminals 11 are installed as a bank having at least four terminals. In the drawing, a double seat connector is illustrated. The upper and lower sides thereof each are installed with respect terminal set. The insulating seat 1 is spaced by a spacer 12 into an upper chamber 13 and a lower chamber 14, another, a ⊏ shape metal clamping piece 3 is installed. The clamping piece 3 is positioned on the spacer 12 and the housing 2. Each of two sides of the connecting piece 31 of the clamping piece 3 is protruded with a combining portion 32 for being connected to a ground piece 4. The ground piece 4 has a T shape with one end being a retainer 41 and two ends being resisting portions 42. Each retainer 41 is inserted into the inner surface of the meddle connecting piece 31 of the clamping piece 3 so that the retainer 41 near the resisting portion 42 is installed with a pressed buckling portion 43, and thereby, after the combining portion 32 is inserted into a hollow space 44 within the buckling portion 43, it is pressed to be combined and fixed therein. Namely, the buckling portion 43 is tightly pressed in a reverse direction for removing the space in the hollow space. Since a tilt bending portion 45 obliquely extends between the buckling portion 43 of the retainer 41 and the resisting portion 42. The resisting portion 42 is a middle connecting piece 31 parallel to the clamping piece 31 (as that shown in the dashed line of FIG. 4).

The clamping piece 3 is formed by a pair of lateral pieces 33 and the middle connecting piece 31. Two lateral sides of each lateral piece 33 each are installed with a respective hook 34. The hook 34 is buckled to a retaining hole 21 of the housing 2 so that the clamping piece 3 can be positioned. Besides, outer edge of the lateral piece of the clamping piece 3 is installed with a T block 35 for being buckled into a respective position of the insulating seat l. Each lateral piece 33 is installed with a pair of positioning protrusions 36. The protrusion 36 has a tight clamping effect to the inserted connecting device.

Figure 4:
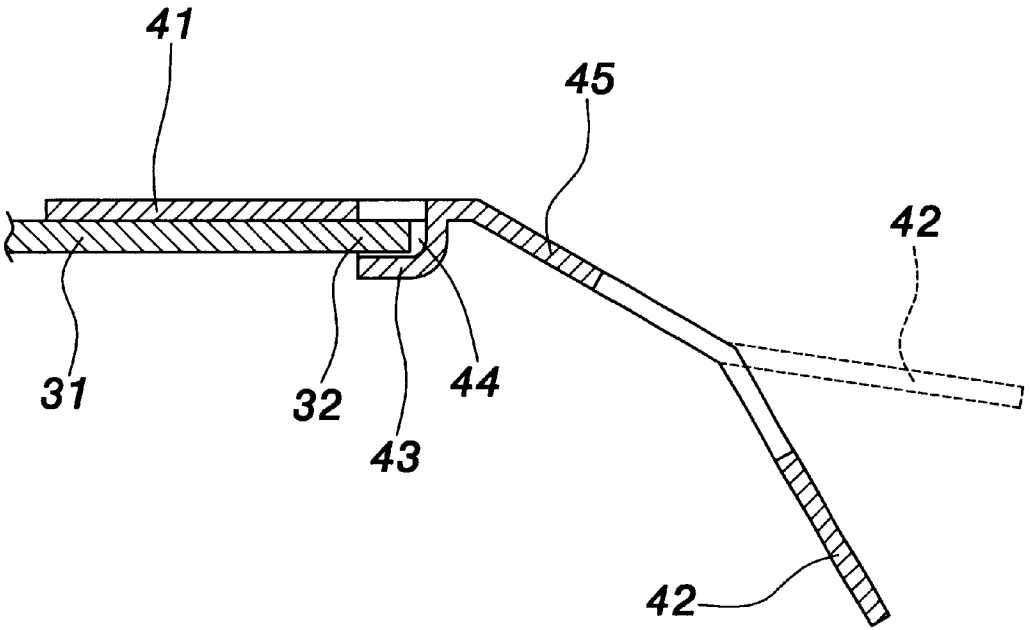
FIG. 4 is an assembled partial cross sectional view of the present invention.
Figure 5:
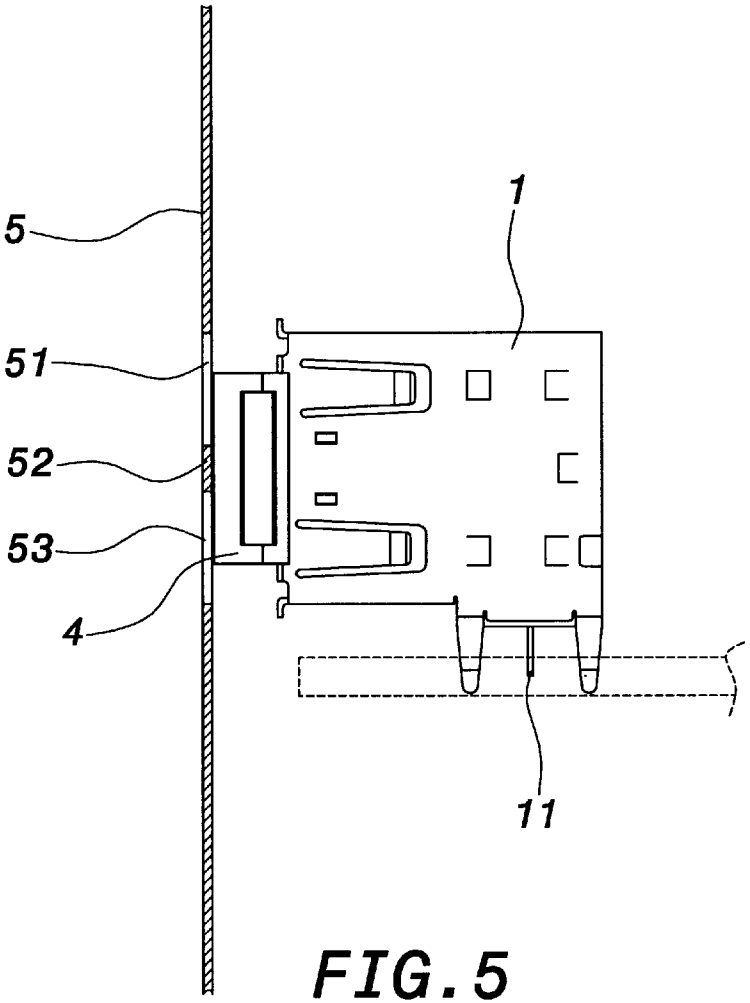
FIG. 5 is a cross sectional view showing an embodiment of the present invention.
Figure 6:
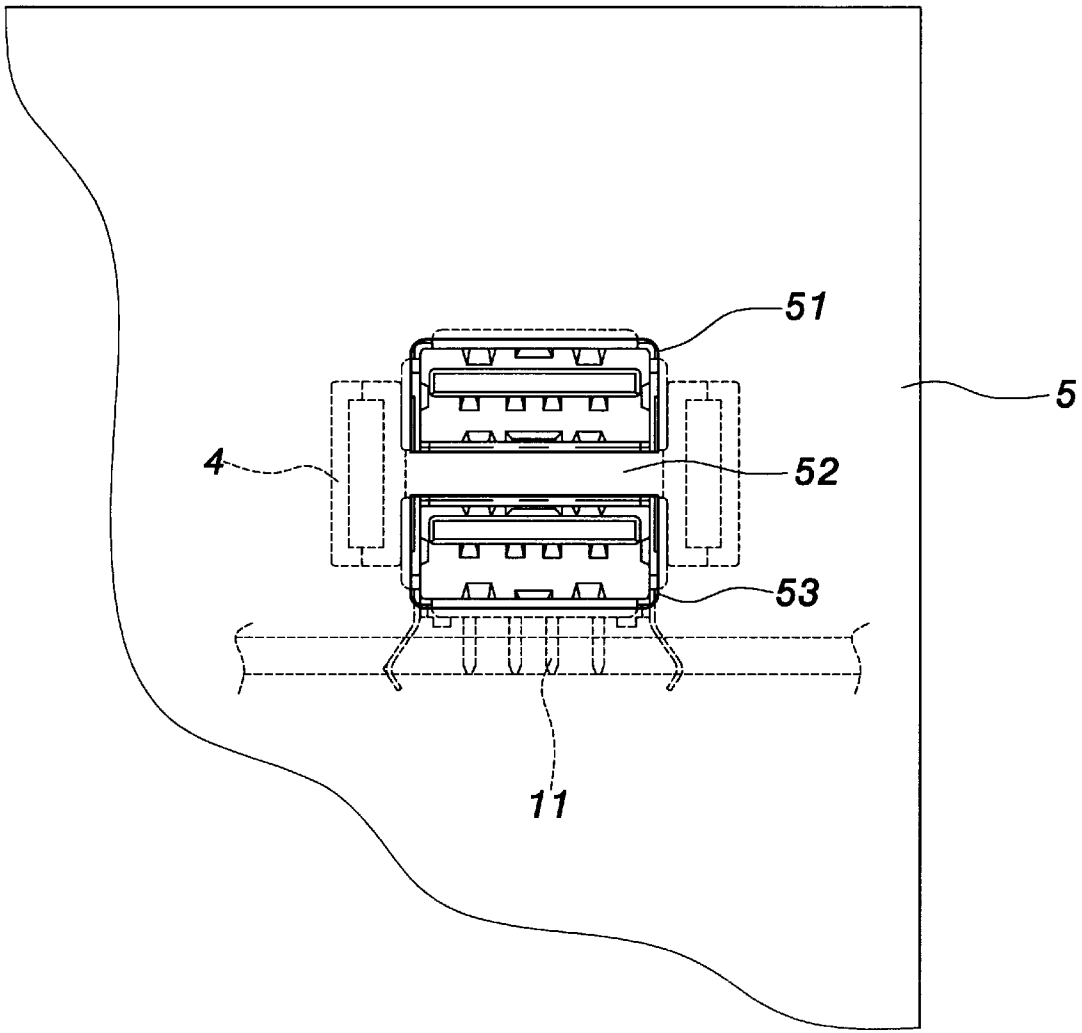
FIG. 6 is a lateral schematic view of an embodiment of the present invention.

In the aforesaid structure of the present invention, the contact area is enlarged by the ground piece 4. The combination of the ground piece 4 and clamping piece 3 is illustrated in FIG. 4. Furthermore, as shown in FIGS. 5, and 6, it is illustrated that the connector of the present invention is installed on a motherboard of a mainframe so as to be combined with the housing 5. Since an upper square hole 51 and a lower square hole 52 with a retaining strip 152 are formed on the housing 5, in the position of the retaining strip 52 with respect to the clamping piece 3, the square holes 51, and 53 are installed with respective to a double seat connector for being suitable to a receptacle connector illustrated in the drawing of the present invention.

Therefore, the resisting portion obliquely extended and having a plane shape is in contact with a housing so that the ground piece is connected to the housing in a surface contact way. The contact area is sufficient. Consequently, the ground piece is substantially guided and can be used for a longer time with fatigue in elasticity. A steady combination is formed with the housing. Even a matched connector is in a pulling away condition, it can acquire an inverse holding force so that the connector can be protected well and provides a well application.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A grounding device of an electric connector comprising:

an insulating seat having a plurality of terminals and having with a spacer;

a metal housing enclosing the insulating seat and;

a metal clamping piece having a ⊏ shape the clamping piece being attached to the spacer and the housing; two lateral sides of a middle connecting piece of the clamping piece each having with a combining portion; and a pair of metal ground pieces each having a T shape with one end being a retainer and another two ends being resisting portions; each retainer being inserted into the middle connecting piece of the clamping piece; a punched buckling portion being formed on the retainer near the resisting portion, the combining portion being inserted into a hollow chamber in the buckling portion and being pressed and thus fixed therein; between the buckling portion of the retainer and the resisting portion there being an oblique extended bending portion.

2. The grounding device of an electric connector as claimed in claim 1, wherein the housing has retaining holes; the clamping piece is formed by a pair of lateral pieces and a middle connecting piece; two lateral sides of each lateral piece each are formed with a respective hook; and the hook is buckled to the respective retaining hole of the housing.

3. The grounding device of an electric connector as claimed in claim 2, wherein an outer side of each lateral piece of the clamping piece is installed with a T block, and the T block is buckled into a respective portion of the insulating seat.

4. The grounding device of an electric connector as claimed in claim 1, wherein the resisting portion of the ground piece are parallel to the middle connecting piece of the clamping piece.

* * * * *